US005390852A

United States Patent [19]

Schuenemann et al.

[11] Patent Number: 5,390,852

[45] Date of Patent: Feb. 21, 1995

[54] PORTABLE MISTING DEVICE HAVING A ROTTABLE SPRAY ARM

[75] Inventors: Helen E. Schuenemann, 727 S. Alma St., #11, San Pedro, Calif. 90731; Mark O. McSpadden, San Pedro, Calif.; Paul A. Berman; Darrell G. Greenland, both of Los Angeles, Calif.; Kenneth Tarlow, Santa Monica, Calif.

[73] Assignees: Helen E. Schuenemann; Mark McSpadden, both of San Pedro, Calif.

[21] Appl. No.: 51,169

[22] Filed: Apr. 22, 1993

[51] Int. Cl.[6] ..... B05B 3/00

[52] U.S. Cl. ..... 239/263.1; 239/332; 239/265; 239/281; 4/615

[58] Field of Search ..... 239/302, 331, 332, 225.1, 239/226, 263.1, 263.3, 264, 265, 279-281, 578, 289; 4/602, 603, 615-618; 251/294

[56] References Cited

U.S. PATENT DOCUMENTS

| | | | |
|---|---|---|---|
| 2,267,169 | 12/1941 | Rast | 239/578 |
| 2,829,379 | 4/1958 | McGee | 4/615 |
| 2,923,480 | 2/1960 | Christian | 239/302 |
| 3,760,431 | 9/1973 | Schwibner | 4/616 |
| 3,901,449 | 8/1975 | Bochmann | 239/332 |
| 3,939,503 | 2/1976 | Nazworth | 4/616 |
| 4,846,525 | 7/1989 | Manning | 239/289 |
| 4,854,502 | 8/1989 | Cox | 239/289 |
| 4,962,888 | 10/1990 | Beccaria et al. | 239/281 |
| 5,111,538 | 5/1992 | Chapman | 4/615 |
| 5,156,339 | 10/1992 | Gibson et al. | 239/289 |

FOREIGN PATENT DOCUMENTS

| | | | |
|---|---|---|---|
| 1494317 | 9/1967 | France | 239/332 |

*Primary Examiner*—Karen B. Merritt
*Attorney, Agent, or Firm*—Kelly, Bauersfeld & Lowry

[57] ABSTRACT

An improved portable misting device comprising a portable liquid holding container and a spray arm projecting upward from the liquid holding container and being retractable and extendable to a desired elevation above the top of the liquid holding container. A single small aperture misting spray head is mounted on one end of the spray arm. A rocker arm is pivotally mounted adjacent one side of the top of the liquid holding container and is linked to the spray arm to cause horizontal rotation of the spray head. On top of the liquid holding container is a flat table upon which accessories may be placed. An electric motor, for pumping liquid from the liquid holdiong container through the misting spray head, is located within the main housing. A pressure-actuated switch is located under the rocker arm and the pump is activated when light pressure is applied to the rocker arm.

23 Claims, 3 Drawing Sheets

PORTABLE MISTING DEVICE HAVING A ROTTABLE SPRAY ARM

BACKGROUND

1. Field of Invention

This invention relates to misting devices and is particularly directed to personal misting devices for use by sunbathers, loungers and the like.

2. Prior Art

Sunbathing and lounging in the backyard, around a swimming pool and at the beach are popular pastimes, especially in warm or hot climates. However, when sunbathing and lounging outdoors, the individual is often exposed to warm or hot climatic air temperatures, which are often uncomfortable and, at times, distressing for the person to experience. This particular discomfort is frequently caused or heightened by the individual experiencing the direct rays of the sun upon his or her skin. In addition, it has been shown that the direct sun-rays can cause damage to the person's skin and that this damage can be diminished or eliminated if a moisturizer or sun screening agent is applied to the skin prior to the skin being exposed to the burning rays of the sun. These heretofore mentioned problems can be reduced by periodically spraying or anointing the sunbather or the lounger with a light mist or film of pure water or water containing a skin moisturizer or sun screening agent. Unfortunately, warmth induces a state of relaxation in the sunbather to the point that the sunbather often becomes so relaxed or drowsy that he or she is reluctant to initiate the effort to cool himself or herself off (i.e., cool his or her skin) or initiate the effort to place a moisturizing or sun screening agent on his or her skin. If, however, little effort was required to perform these tasks, the sunbather would be much more likely to initiate these tasks.

Numerous devices have been proposed and developed heretofore to alleviate or overcome these above-mentioned problems. However, many of the prior art devices intended to either cool the sunbather's skin or facilitate application to the sunbather's skin of a moisturizer or sun screening agent require considerable volition and action on the part of the sunbather, which is behavior that tends to be incompatible with the relaxed, lethargic mood of the sunbather, as previously described. In addition, other prior art devices are permanent fixed installations (impossible to move from one location to another), which prevent or greatly restrict the mobility of the sunbather or the outdoors person who is seeking to have the skin on his body cooled. Permanent fixed installations are also expensive to install. Thus, these permanent fixed cooling, misting devices may be useful only in a given location and cannot be moved to other locations. For example, they can be located adjacent a swimming pool, but can not be moved to a beach, park, a desert or any other desirable sun bathing location. In addition, the area in which the sunbather can move his or her lounge chair may be extremely limited and, hence, can restrict the social interaction of a group of sunbathers or limit the use of these permanent fixed cooling devices. Other prior art misting devices have been designed to spray a mist of liquid only in a very limited area, so as to cover, for example, an arm, a chest, a leg or another selected portion of the sunbather's anatomy and have required the sunbather to exert a great deal of gross motor activity and effort in order to be able to spray a mist of water over his or her entire body. Still other prior art misting devices have been complex mechanisms which have required very considerable maintenance. Other prior art misting devices have been relatively expensive. Thus, none of the prior art misting devices have been entirely satisfactory.

BRIEF SUMMARY AND OBJECTS OF INVENTION

These disadvantages of the prior art are overcome with the present invention. The present invention, which is an improved misting device, is relatively inexpensive, compact and simple to construct, versatile in its function, requires little maintenance and can easily be transported from one location to another, can be operated with very little effort or volition required and provides effective distribution of the coolant, moisturizer or sun screening solutions over the sunbather's entire body or any selected portion of his or her body. Furthermore, when compared to a water hose or other cooling devices, the misting device of the present invention makes much more efficient use of water.

These advantages of the present invention are preferably attained by providing an improved misting device comprising a portable, refillable, fluid reservoir (i.e., the main unit of the device), a spray arm extending (i.e., projecting) both upward and outward from the main unit of the misting device and extendable to a desired elevation above the top of the reservoir, an easy to remove spray head located at the end of the spray arm, a rocker arm pivotally mounted on one side of the top of the reservoir, a pump for spraying liquid from the reservoir through the spray arm and spray head, a pressure-actuated switch controlling the pump in response to light pressure being placed upon the rocker arm, and linkage between the rocker arm which will permit rotation of the spray head on the horizontal plane by moving the rocker arm.

Accordingly, it is an object of the present invention to provide an improved misting device.

Another object of the present invention is to provide an improved misting device which is inexpensive, compact and simple in construction.

A further object of the present invention is to provide an improved misting device which greatly facilitates the application and distribution of water, a moisturizing agent or a sun screening agent over the user's body.

An additional object of the present invention is to provide an improved misting device which requires little, if any, maintenance.

A further object of the present invention is to provide an improved misting device which can easily be transported from one location to another.

Another object of the present invention is to provide an improved misting device which can be operated with very little effort or volition required on the part of the sunbather.

An additional object of the present invention is to provide an improved misting device which provides effective distribution of water, a moisturizing or sun screening agent over the sunbather's entire body.

A specific object of the present invention is to provide an improved misting device comprising a portable misting device, a spray arm projecting upwardly from the main unit of the misting device and extendable to a desired elevation above the top of the reservoir, a rocker arm pivotally mounted on the top of the reservoir, a pump for spraying liquid from the reservoir through the spray head, a pressure-actuated switch controlling the pump in response to pressure on the rocker arm, and means linking the rocker arm to cause rotation of the spray head.

These and other objects and features of the present invention will be apparent from the following detailed description, taken with reference to the figures of the accompanying drawing.

DETAILED DESCRIPTION OF THE INVENTION

Figure 1:
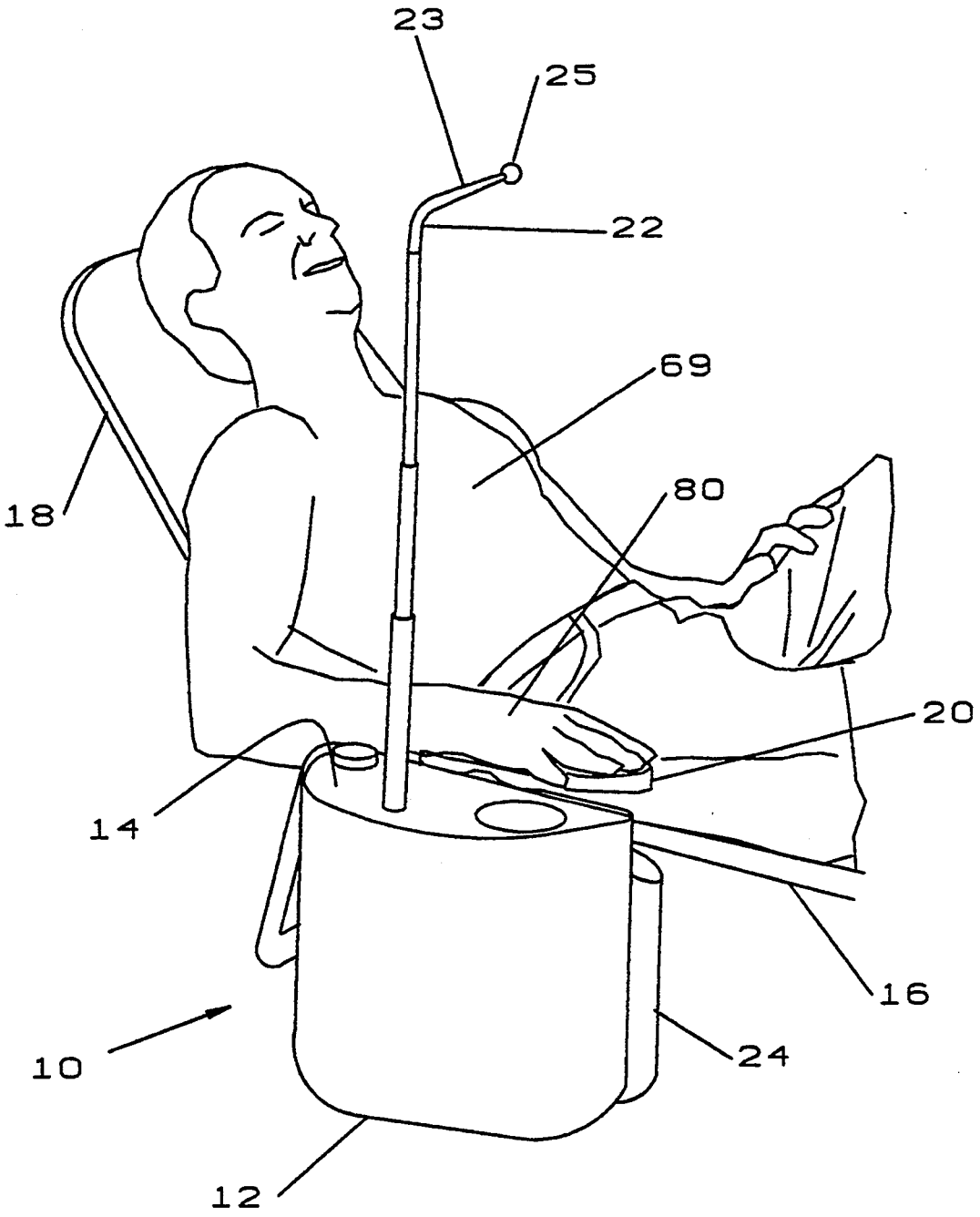
FIG. 1 is a diagrammatic representation of a misting device embodying the present invention.
Figure 2:
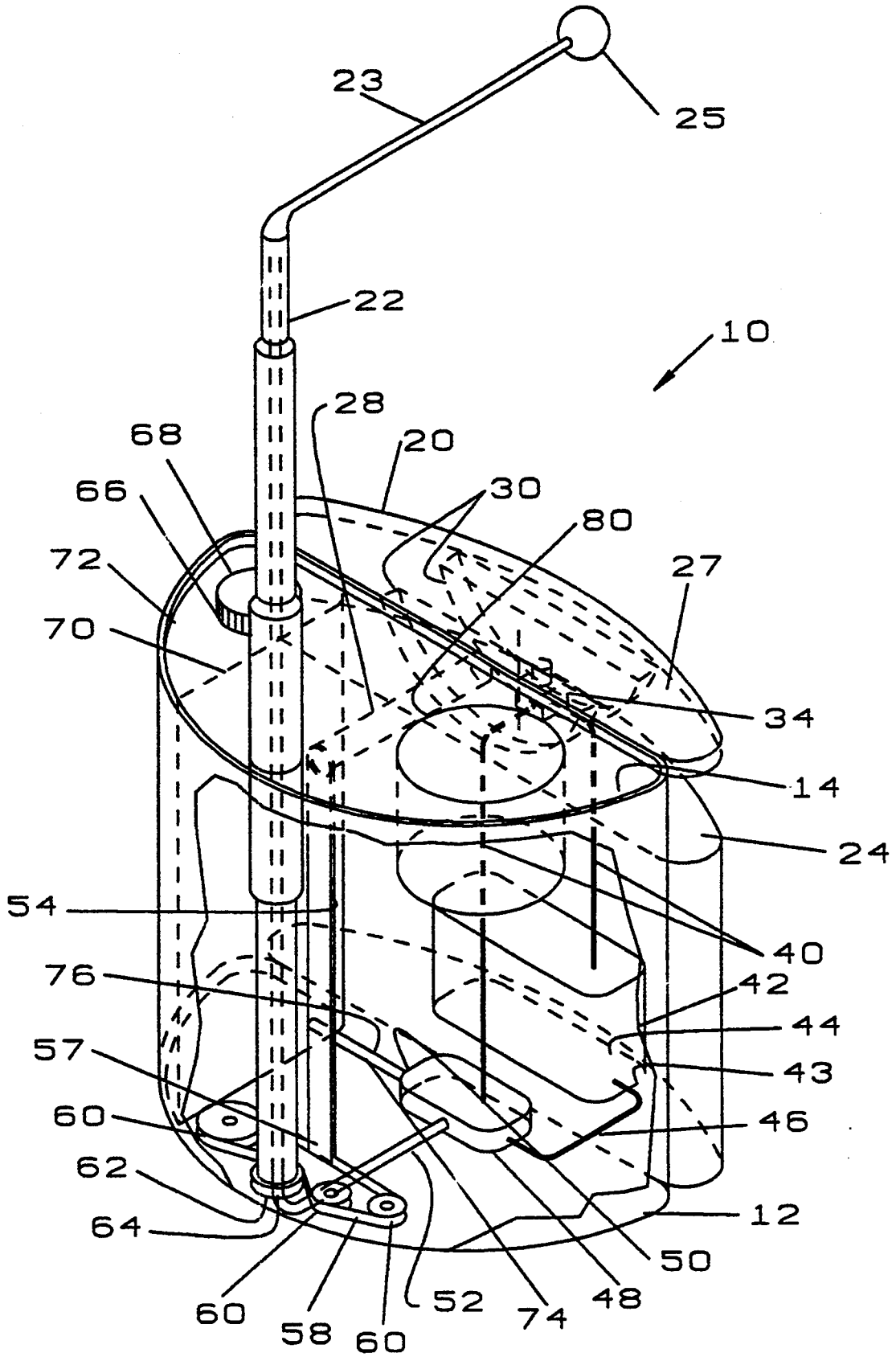
FIG. 2 is a view of the misting device of FIG. 1 with part of the reservoir broken away for clarity.
Figure 3:
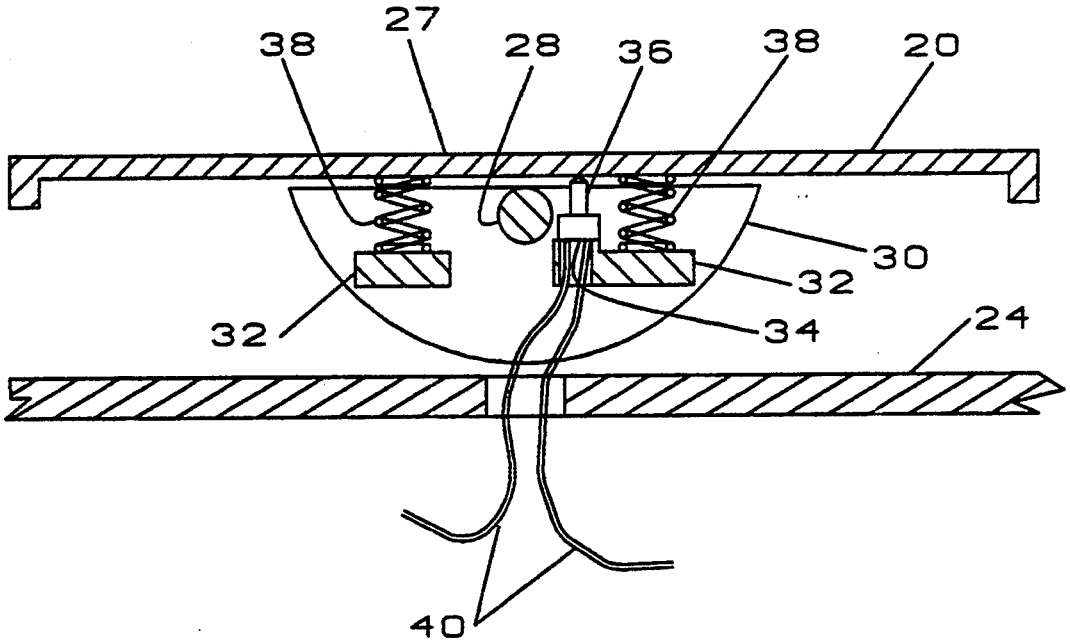
FIG. 3 is an enlarged detail view of the pressure switch of the misting device of FIG. 1.

In that form of the present invention chosen for purposes of illustration in the drawing, FIGS. 1–3 show a misting device, indicated generally at 10, comprising a portable reservoir 12, which is the main unit of the misting device 10, and is dimensioned so that the top 14 of the reservoir is approximately the same height as the seat 16 of a standard or ordinary lounge chair 18. A rocker arm 20 is pivotally mounted level with the top 14 of the reservoir 12, preferably off-set to one side, so as to be located close to the lounge chair 18, and an adjustably extensible spray arm 22 projects upwardly from the top 14 of the reservoir 12 and has a generally horizontal tubular member 23 projecting laterally from the upper end of the arm 22 with a spray head 25 mounted at the outer end of the tubular member 23. As best seen in FIGS. 1 and 2, the top 14 of the reservoir 12 has a lowered shelf portion 24 above which the rocker arm 20 is mounted with the upper surface 27 of the rocker arm 20 lying substantially at the same level as the top 14 of the reservoir 12. As best seen in FIGS. 2 and 3, the rocker arm 20 is supported by a pair of parallel rockers 30 which are separated by spacers 32 and is pivotally connected to the reservoir by a horizontal shaft 28. A pressure-actuated switch 34 is mounted on one of the spacers 32 and has an actuator button 36 which is normally urged to its upward "OFF" position. The rocker arm 20 is resiliently supported on the rockers 30 by suitable means, such as springs 38, which normally lift the rocker arm 20 upwardly out of contact with the actuator button 36 of the pressure switch 34. The pressure switch 34 is connected by wires 40 to a suitable power source, such as battery case 42, which is mounted within a recess in the bottom 43 of the reservoir and is covered by a suitable lid 44, located on the bottom 43 of the reservoir 12, which provides access to the battery case 42 for changing the batteries, not shown. The battery case 42 is connected by wires 46 to control a suitable water pump 48. Obviously, if desired, an electrical cord, not shown, could be provided to enable the pump 48 to be connected to conventional electrical sources. The water pump 48 is mounted within the reservoir 12 and serves to take water from the reservoir 12, through inlet opening 50 and to deliver the water through hose 52 up through the lower end 64 of the hollow tube spray arm 22 for delivery through the spray arm 22, lateral extension 23 and spray head 25. The horizontal shaft 28, which is connected to the rockers 30, extends into the interior of the reservoir 12 and connects to a depending arm 54 having a chain 58 secured to the lower end 57 of the depending arm 54. As the rocker arm 20 is rocked, the motion is transmitted by rockers 30 and horizontal shaft 28 to the depending arm 54, causing the lower end 57 of the depending arm 54 to be moved in a pendulum fashion from side to side. The chain 58, attached to the lower end 57 of the depending arm 54, passed about idler wheels 60 to drive sprocket 62, which is mounted on the lower end of the spray arm 22. The lower end of the spray arm 22 is rotatable with the sprocket 62 to cause a corresponding rocking movement of the spray arm 22 and, hence, to distribute the mist of water being discharged by the spray head 25. Finally, a suitable opening 66, having a removable cap 68, may be provided in the top 14 of the reservoir 12 to facilitate emptying and refilling of the reservoir 12. If desired, a removable liquid-holding container 70 may be provided to fit slideably within a suitable recess 72, to allow removal of the container 70 for refilling at a convenient location. When the removable liquid-holding container 70 is provided, a hose 74 is provided to connect the inlet opening 50 of the water pump 48 to the container 70 through a suitable fitting 76. Also, it should be noted that the top 14 of the reservoir 12 is formed to serve as a table and is preferably formed with a suitable recess 80 for releasably retaining a beverage container or the like.

In use, the sunbather 69 adjusts the spray arm 22 to a desired elevation and reclines on the lounge chair 18, or lies on the sand or grass, with his arm 80 resting on the rocker arm 20 of the misting device 10. The weight of the sunbather's arm 80 forces the rocker arm 20 downward, against the action of the spring 38, driving the actuator arm 36 of the pressure switch 34 downwardly to its "ON" position. This closes the electrical circuit from switch 34 through wires 40, battery case 42 and wires 46 to actuated the pump 48. The pump 48 then draws water from container 70, through inlet 50 and supplies the water through hose 52 to be discharged through the spray arm 22 and spray head 25 onto the sunbather 69. If the sunbather 69 rocks his arm 80 forward and rearward, in a teeter-totter fashion, on the rocker arm 20, the rocking motion of the rocker arm 20 will be transmitted through rockers 30 and horizontal shaft 28 to the depending arm 54 in a pendulum fashion which, in turn, drives chain 58 to rotate the spray arm 22 from side to side, clockwise and counterclockwise, to cause the spray head 25 to be similarly rotated from side to side in the horizontal plane to distribute the water sprayed from the spray head 25 over the entire body of the sunbather 69. Since the pressure switch 34 is actuated by the pressure of the sunbather's arm 80 resting on the rocker arm 20 and the rotation of the spray head 25 is accomplished by the sunbather 69 merely rocking his arm 80 forward and rearward on the rocker arm 20, the spraying and distribution of the water in the form of a mist from the reservoir 12 can be accomplished with very little physical or mental effort by the sunbather 69.

Obviously, numerous variations and modifications can be made without departing from the spirit of the present invention. Therefore, it should be clearly understood that the form of the present invention described above and shown in the figures of the accompanying drawing is illustrative only and is not intended to limit the scope of the present invention.

What is claimed is:

1. An improved misting apparatus comprising:

a portable device having a fluid reservoir,
a spray arm projecting upwardly from said device and extendable to a desired elevation above said device,
a spray head mounted on one end of said spray arm,
a pump for spraying liquid from said device through said spray head,
means for moving said spray head backward and forward to cause liquid sprayed by said spray head to be delivered over a desired area,
a rocker arm pivotally mounted on said device, and
linkage means coupling said rocker arm to cause rotation of said spray head.

2. The apparatus of claim 1 further comprising:
a pressure-actuated switch controlling said pump.

3. The apparatus of claim 1 further comprising:
a pressure-actuated switch controlling said pump in response to pressure on said rocker arm.

4. The apparatus of claim 1 wherein:
said spray head is mounted for rocking movement in the horizontal plane.

5. The apparatus of claim 1 wherein:
said linkage means comprises:
means connecting said rocker arm to rotate said spray head clockwise and counterclockwise in a horizontal plane as said rocker arm is rocked.

6. The apparatus of claim 5 wherein:
said drive means is a chain.

7. The apparatus of claim 1 wherein:
said pump is mounted within said device.

8. The apparatus of claim 1 wherein:
said pump is battery powered.

9. The apparatus of claim 1 wherein:
said reservoir is removably mounted in said device.

10. The apparatus of claim 1 wherein:
said spray head is retractable to the level of the top of said device.

11. The apparatus of claim 1 wherein:
said device is formed with a top capable of serving as a table.

12. The apparatus of claim 11 wherein:
said top is formed with a recess for releasably retaining a beverage container.

13. An improved misting apparatus comprising:
a portable device having a fluid reservoir,
a spray arm projecting upwardly from said device and extendable to a desired elevation above said device,
a spray head mounted on one end of said spray arm,
a pump for spraying liquid from said device through said spray head,
means for moving said spray head backward and forward to cause liquid sprayed by said spray head to be delivered over a desired area,
said device formed with a top capable of serving as a table, and
said top is formed with a recess for releasably retaining a beverage container.

14. The apparatus of claim 13 further comprising:
a rocker arm pivotally mounted on said device, and
linkage means coupling said rocker arm to cause rotation of said spray head.

15. The apparatus of claim 14 further comprising:
a pressure-actuated switch controlling said pump in response to pressure on said rocker arm.

16. The apparatus of claim 14 wherein:
said linkage means comprises:
means connecting said rocker arm to rotate said spray head clockwise and counterclockwise in a horizontal plane as said rocker arm is rocked.

17. The apparatus of claim 16 wherein:
said linkage means is a chain.

18. The apparatus of claim 13 further comprising:
a pressure-actuated switch controlling said pump.

19. The apparatus of claim 13 wherein:
said spray head is mounted for rocking movement in a horizontal plane.

20. The apparatus of claim 13 wherein:
said pump is mounted within said device.

21. The apparatus of claim 13 wherein:
said pump is battery powered.

22. The apparatus of claim 13 wherein:
said reservoir is removably mounted in said device.

23. The apparatus of claim 13 wherein:
said spray head is retractable to the level of a top of said device.

* * * * *